United States Patent [19]

Zidele

[11] 4,366,580

[45] Jan. 4, 1983

[54] REVERSIBLE GLOVE

[76] Inventor: Israel Zidele, 1303 Ditmas Ave., Brooklyn, N.Y. 11226

[21] Appl. No.: 242,642

[22] Filed: Mar. 11, 1981

Related U.S. Application Data

[63] Continuation-in-part of Ser. No. 195,942, Oct. 10, 1980.

[51] Int. Cl.[3] ..... A41D 13/10

[52] U.S. Cl. ..... 2/19

[58] Field of Search ..... 2/19, 16, 2, 161 A

[56] References Cited

U.S. PATENT DOCUMENTS

| | | | |
|---|---|---|---|
| 2,324,219 | 7/1943 | Latina | 2/19 |
| 2,521,488 | 9/1950 | Smith | 2/19 |
| 2,699,551 | 1/1955 | Tompkins | 2/19 |
| 3,098,234 | 7/1963 | Latina | 2/19 |
| 3,300,787 | 1/1967 | Denkert | 2/19 |
| 4,227,263 | 10/1980 | Zidele | 2/19 |

*Primary Examiner*—H. Hampton Hunter

[57] ABSTRACT

A reversible baseball or other glove useable by both right-handed and left-handed players includes a juxtaposed front and rear piece of flexible sheet material, each said piece provided with a middle finger stall, two intermediate finger stalls and two outer finger stalls, a palm portion, and a heel portion, said front piece having a first cutout therein, said first cutout extending upwardly in a curved configuration into and across said palm portion of said front piece from said heel portion of said front piece, said rear piece having a second cutout therein, said second cutout extending upwardly in a curved configuration into and across said palm portion of said rear piece from said heel portion of said rear piece; a web disposed between one of said outer finger stalls and the adjoining finger stall; lacing or welting means for peripherally interconnecting said front piece and said rear piece, wherein said lacing means joins said web to said front piece and said rear piece; a first geometrically shaped planar member of substantially identical shape to the shape of said first cutout of said front piece, said first geometrically shaped planar member being disposed within said first cutout of said front piece; a first means for movably interconnecting said first geometrically shaped member to said front piece; a second geometrically shaped planar member of substantially identical shape to the shape of said second cutout of said second cutout of said rear piece, said second geometrically shaped planar member being disposed within said second cutout of said rear piece; and second means for movably interconnecting said second geometrically shaped member to said rear piece.

8 Claims, 10 Drawing Figures

REVERSIBLE GLOVE

CROSS REFERENCE TO RELATED APPLICATION

The instant application is a continuation-in-part application of Ser. No. 195,942 filed on Oct. 10, 1980.

BACKGROUND OF THE INVENTION

Field of the Invention

A reversible baseball or other glove useable by both right-handed and left-handed players includes a juxtaposed front and rear piece of flexible sheet material, as described in the Disclosure Document Program, 095823 filed on Nov. 25, 1980, each said piece provided with the conventional stalls of a fielder's glove or mitten shaped glove, a palm portion, and a heel portion, said front piece having a first cutout therein, said first cutout extending upwardly in a curved or trapezoidal configuration into and across said palm portion of said front piece from said heel portion of said front piece, said rear piece having a second cutout therein, said second cutout extending upwardly in a curved or trapezoidal configuration into and across said palm portion of said rear piece from said heel portion of said rear piece; a web disposed between one of said outer finger stalls and the adjoining finger stall; lacing means for peripherally interconnecting said front piece and said rear piece, wherein said lacing means joins said web to said front piece and said rear piece; a first geometrically shaped planar member of substantially identical shape to the shape of said first cutout of said front piece, said first geometrically shaped planar member being disposed within said first cutout of said front piece; a first means for movably interconnecting said first geometrically shaped member to said front piece; a second geometrically shaped planar member of substantially identical shape to the shape of said second cutout of said rear piece, said second geometrically shaped planar member being disposed within said second cutout of said rear piece; and second means for movably interconnecting said second geometrically shaped member to said rear piece.

Baseball gloves or mitts are known, e.g. from U.S. Pat. No. 2,521,488 which can be used with either the left or the right hand by having a compartment formed between a removable padding and one of two sheets, the padding coming to lie against the palm of the inserted hand. According to the disclosing of that patent, the stalls for the index and middle fingers are separated from the thumb stall by a relatively wide web of generally triangular shape and from the two remaining stalls, also joined together, by a similar but narrower web. It is also known to interconnect the front and rear sheets of a baseball glove by lacing which extends along the lateral sheet edges as well as along the peripheries of their extensions defining the finger stalls; see, for example, U.S. Pat. Nos. 2,324,219; 2,699,551; 2,281,315, 3,042,929; 3,098,234; 3,300,787 and 3,528,107. Some of these prior patents also show a web secured by the lacing to adjoining finger stalls.

A reversible baseball glove of the conventional type has the disadvantage that the front face of the glove, formed by either of the two peripherally interconnected sheets depending on which hand is being used, does not readily assume the proper concave shape required for the catching of an oncoming ball. Thus, if the two sheets are mutually coextensive when flat, the sheet coming to lie on the convex rear surface would have to be excessively stretched when the glove is curved forward by the player's fingers reaching for a ball.

SUMMARY OF THE INVENTION

A reversible baseball glove useable by both right-handed and left-handed players includes a juxtaposed front and rear piece of flexible sheet material, each said piece provided with conventional finger stalls, or are mitten shaped, a palm portion, and a heel portion, said front piece having a first cutout therein, said first cutout extending upwardly in a curved or trapezoidal configuration into and across said palm portion of said front piece from said heel portion of said front piece, said rear piece having a second cutout therein, said second cutout extending upwardly in a curved or trapezoidal configuration into and across said palm portion of said rear piece from said heel portion of said rear piece; a web disposed between one of said outer finger stalls and the adjoining finger stall; lacing and/or welting means for peripherally interconnecting said front piece and said rear piece, wherein said lacing means joins said web to said front piece and said rear piece; a first geometrically shaped planar member of substantially identical shape to the shape of said first cutout of said front piece, said first geometrically shaped planar member being disposed within said first cutout of said front piece; a first means for movably interconnecting said first geometrically shaped member to said front piece; a second geometrically shaped planar member of substantially identical shape to the shape of said second cutout of said rear piece, said second geometrically shaped planar member being disposed within said second cutout of said rear piece; and second means for movably interconnecting said second geometrically shaped member to said rear piece. An important object of my invention is to provide a means for increasing the flexibility of the front or rear pieces of the glove thereby improving the ability to flex the glove in either direction depending upon whether the glove is to be worn on the left or right hand of the player.

An important object of my present invention, therefore, is to provide an improved baseball glove and of the reversible type which can be readily worn on the left or right hand of a player.

Another object is to provide means in such a baseball glove facilitating the circulation of air through its interior, especially at a time when the player exerts an extra effort in intercepting and firmly gripping a ball.

BRIEF DESCRIPTION OF THE DRAWING

The above and other features of my invention will become more readily apparent from the following detailed description, reference being made to the accompanying drawing in which.

DESCRIPTION OF THE PREFERRED EMBODIMENTS

Figure 1:
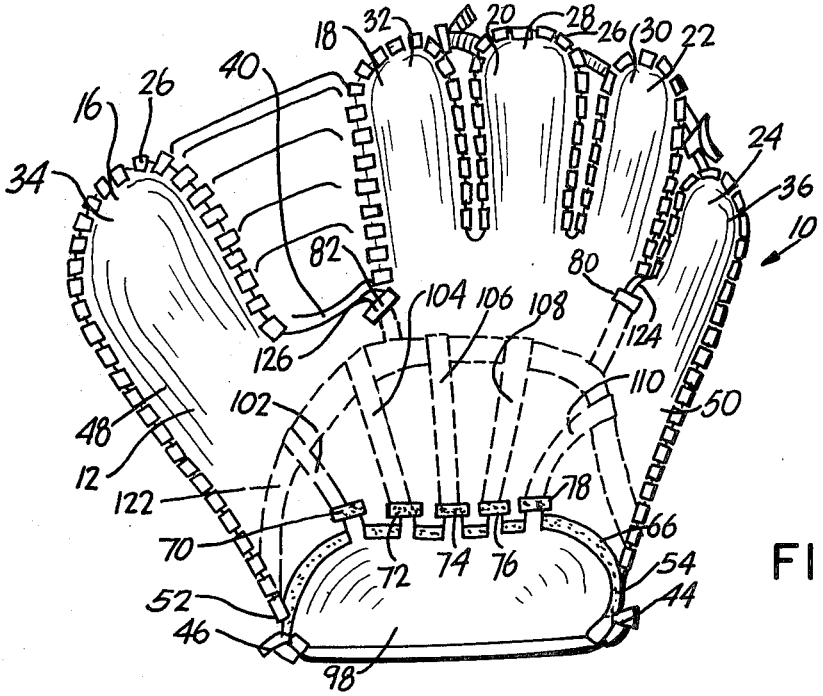
FIG. 1 illustrates a front perspective view of a first embodiment of the reversible baseball glove.
Figure 2:
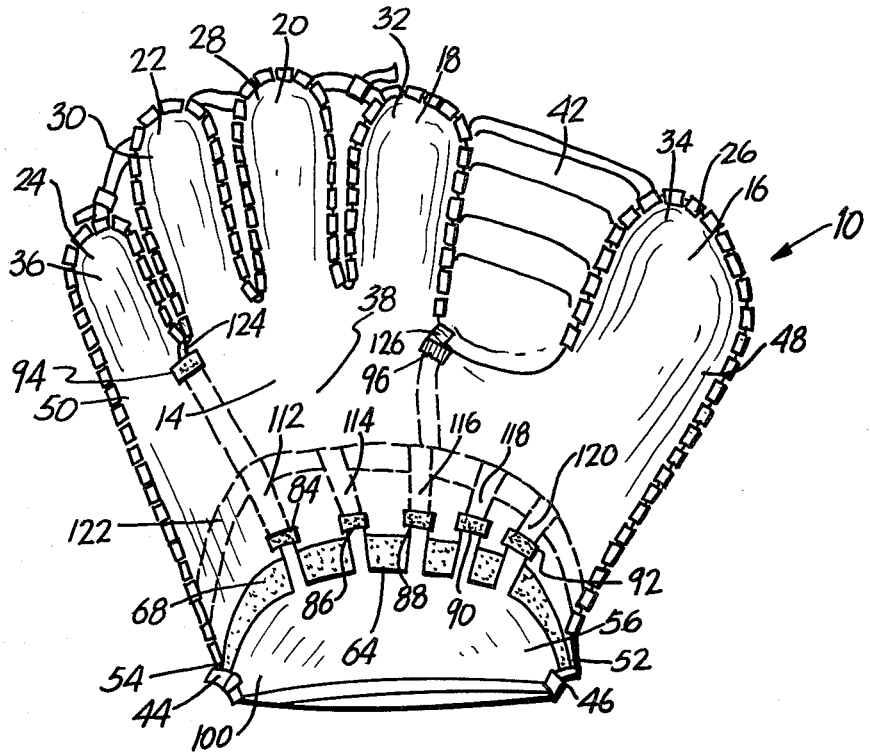
FIG. 2 illustrates a rear perspective view of the first embodiment of the reversible baseball glove.

The reversible baseball glove 10 as shown in FIGS. 1–3, 7 and 10, is adaptable to be worn either on the left or right hand of a player. The glove 10 generally comprises a front piece 12 and a back piece 14 of tough, flexible sheet material, such as leather or vinyl plastic, wherein each piece 12, 14 has five projections 16, 18, 20, 22, 24 along an upper edge of each piece 12, 14. The three center projections of each piece are joined together by lacing means 26 into a middle 28 and two intermediate finger stalls 30, 32 of the glove 10, wherein the finger stalls 28, 30, 32 are adapted to receive the three center fingers of a player's hand therein. The two outermost finger stalls 34, 36 formed by joining the projections 16, 24 of each piece 12, 14 together by the lacing means 26. Finger stall 34, is adapted to receive either the thumb of the left or the right hand of the player therein, wherein the little finger of the hand is accommodated in the stall 36.

A web 42 of similar material to that of pieces 12, 14 is positioned in the U-shaped opening between the thumb stall 34 and index finger stall 32. The web 42 is joined by the lacing means 26 to the finger stalls 32, 34 and to the pieces 12, 14 in the pocket portion 38 of the glove 10 along the bottom portion of the U-shaped opening 40. The lacing means 26 is continuous through the five finger stalls 34, 32, 28, 30, 36 and the web 42, wherein each of the ends 44, 46 of the lacing means 26 extend down along the respective sides 48, 50 of the glove 10 thereby joining the front 12 and back 14 pieces together.

The lacing means 26 is loose along the sides 48, 50 of the glove 10 thereby loosing joining pieces 12, 14 together. This provides for increased flexibility in pieces 12, 14 when they are respectively stretched as they form the rear portion of the glove 10 depending upon whether the glove 10 is worn on the player's left or right hand.

The ends 44, 46 of the lacing means 26 terminate at the lower end of each side 54, 52 of the heel section 56 of the glove 10. The lacing means 26 is laced through the two pieces 12, 14 and the web 42 in any desirable stitch, but as depicted in the FIGS. 1–3, but not limiting it in scope, is a saw tooth configuration. The bottom edges of each piece 12, 14 are not joined together thereby allowing the player's hand to be inserted upwardly and inwardly in the chamber formed between the two pieces 12, 14. A layer of padding 62 is disposed between the front 12 and back 14 pieces of the glove 10, and the padding 62 is of the same general configuration as that of either piece 12, 14. The lacing means 26 also extends through the padding 62 along the sides 48, 50 and the finger stalls 34, 32, 28, 30, 36 of the glove 10.

Figure 3:
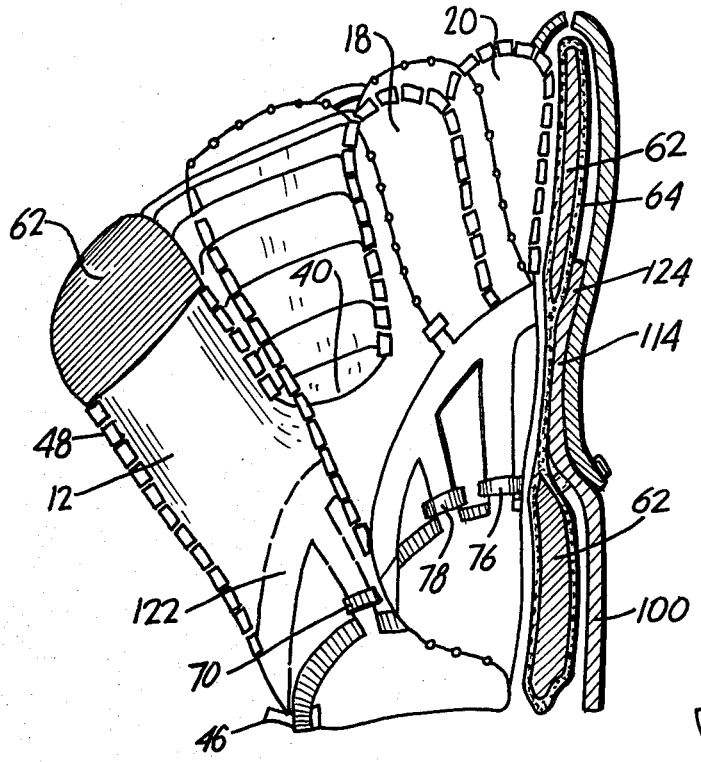
FIG. 3 illustrates a front partially cutaway view of the first embodiment of the reversible baseball glove.
Figure 6:
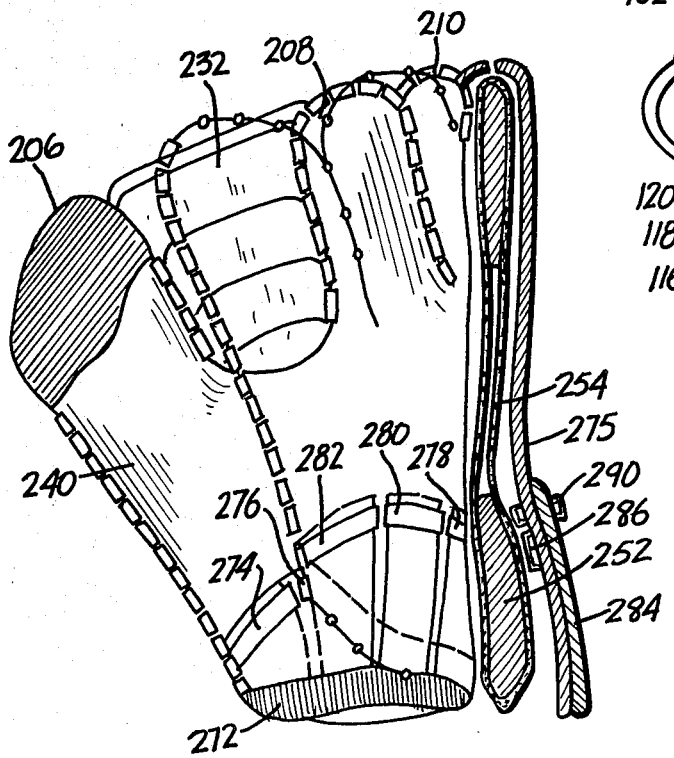
FIG. 6 illustrates a front partially cutaway view of the second embodiment of the reversible baseball glove.

A lining 64 can be provided for the padding 62 which can be of unitary construction as in FIG. 3 or two identical portions, wherein each piece is of the same general configuration as those of pieces 12, 14 or padding 62, as in FIG. 6. One portion of the lining 64 is disposed between padding 62 and front piece 12 and the other portion of the lining 64 is disposed between padding 62 and the back piece 14. The portions of the lining 64 are joined to the padding 62 by stitching means or alternately or in conjunction with by means of the lacing means 26 extending also through the portions of the lining 64 along the finger stall sections 34, 32, 28, 30, 36 and the sides 48, 50 of the glove 10. The lower ends of each portion of the liner 64 are joined together either in a unitary construction as depicted or alternately by one of lacing means 26 (not shown) extending across the bottom edge of the portions of the lining 64 and through the padding 62. The bottom portion of the front piece 12 has a first geometrically shaped cutout 66 therein, wherein the curved portion of the cutout 66 extends upwardly, inwardly and across the pocket portion of the glove 10. The bottom edge of the rear piece 14 has a second geometrically shaped cutout 68 therein, wherein the cutout 68 extends upwardly, inwardly and across the back pocket portion of the glove 10. The front piece 12 of the glove 10 has five slots 70, 72, 74, 76, 78 therethrough, wherein the slots 70, 72, 74, 76, 78 are spaced apart and disposed along the periphery of the cutout 66 of front piece 12. The front piece 12 of the glove 10 has at least two openings 80, 82 therethrough wherein one of openings 80 is disposed at and just below the juncture of the outermost finger stall 36 and the intermediate finger stall 30. The other opening 82 is disposed at and just below the juncture of the intermediate finger stall 32 and the U-shaped opening 40. The back piece 14 of the glove 10 has five slots 84, 86, 88, 90, 92 therethrough, wherein the slots 84, 86, 88, 90, 92 are spaced apart and disposed along the periphery of the cutout 68 of back piece 14. The back piece 14 of the glove 10 has at least two openings 94, 96 therethrough, wherein one of the openings 94 is disposed at and just below the juncture of the outermost finger stall 36 and the intermediate finger stall 30. The other opening 96 is disposed at and just below the juncture of the intermediate finger stall 32 and the U-shaped opening 42.

A first geometrically shaped element 98 which is formed from the same type of material as that of the front 12 or rear 14 pieces is disposed within cutout 66 of the front piece 12 wherein the geometrically shaped element 98 is of the same geometrical shape as that of the geometrically shaped cutout 66 of the front piece 12 of the glove 10. A second geometrically shaped element 100 which is formed from the same material as that of the front 12 or rear 14 pieces is disposed within the geometrically shaped cutout 68 in the rear piece 14 of the glove 10, wherein the geometrically shaped element 100 is of the same geometrical shape as that of the geometrically shaped cutout 68 of the rear piece 14 of the glove 10. A first set of five elongated straps 102, 104, 106, 108, 110 radiate outwardly from the upper edge of the first geometrically shaped element 98, wherein the straps 102, 104, 106, 108, 110 are spaced apart such that each of the straps 102, 104, 106, 108, 110 extend upwardly across the border of exterior surface of front piece 12 and one of each of the straps 102, 104, 106, 108, 110 extends inwardly through one of each of the slots 70, 72, 74, 76, 78 in the front piece 12, wherein the straps 102, 104, 106, 108, 110 terminate in the space defined between the front piece 12 and the lining 64. A second set of five elongated straps 112, 114, 116, 118, 120 radiate outwardly from the upper edge of the second geometrically shaped element 100, wherein the straps 112, 114, 116, 118, 120 are spaced apart such that each of the straps 112, 114, 116, 118, 120 extend upwardly across the border of exterior surface of rear piece 14 and one of each of the straps 112, 114, 116, 118, 120 extends upwardly through one of each of the slots 84, 86, 88, 90, 92 of the rear piece 14, wherein the straps 112, 114, 116, 118, 120 terminate in the space defined between the rear piece 14 and the lining 64.

A continuous belt member 122 is disposed within the glove member, wherein the belt member 122 extends from the juncture of the bottom end of one side 50 of the glove 10 upwardly, inwardly, and across the palm area of the glove 10 between the lining 64 and the front piece 12 of the glove 10 and then downwardly towards the bottom end of the outer side 48 of the glove 10 and then around and over the outer pieces 12 and 14 through slots near their corners at the bottom end of side 48 of the glove and upwardly, inwardly and across the back of the palm area of the glove 10 between the lining 64 and the rear piece 14 of the glove 10 and then downwardly towards the bottom end of side 50 of the glove and then around and over the outer pieces 14 and 12 through slots near their corners. The ends of the first straps 102, 104, 106, 108, 110 are either permanently or removably joined to belt member 122 within the space defined between the front piece 12 and the lining 64. The ends of the second straps 112, 114, 116, 118, 120 are either permanently or removably joined to the belt member 122 within the space defined between the rear piece 14 and the lining 64. A first inverted U-shaped strap member 124 extends through openings 80 and 94 of the front 12 and rear 14 pieces respectively, wherein the legs of strap member 124 extends downwardly into the spaces defined between the rear piece 14 and the lining 64 and the front piece 12 and the lining 64 and the ends of legs of strap member 124 are either permanently or removably joined to belt member 122, wherein the base of the inverted U-shaped strap member 124 is disposed externally to the front 12 and rear 14 pieces and loops over the juncture of the front 12 and rear 14 pieces between the outermost finger stall 36 and the intermediate finger stall 30.

A second inverted U-shaped strap member 126 extends through openings 82 and 96 of the front 12 and rear 14 pieces respectively, wherein the legs of strap member 126 extends downwardly into the spaces defined between the rear piece 14 and the lining 64 and the front piece 12 and the lining 64 and the ends of legs of strap member 126 are either permanently or removably joined to belt member 122, wherein the base of the inverted U-shaped strap member 126 is disposed externally to the front 12 and rear 14 pieces between the thumb 34 and the intermediate finger stall 32. Additional inverted U-shaped strap members can be provided, wherein the ends of each U-shaped strap member are joined to the belt member 122 or directly to geometrically shaped elements 98 and 100 as in FIG. 10, and the base of the inverted U-shaped members are disposed externally to the glove 10 between two of the finger stalls 34, 32, 28, 30, 36. Obviously, up to about six of these inverted U-shaped straps can be employed.

Figure 7:
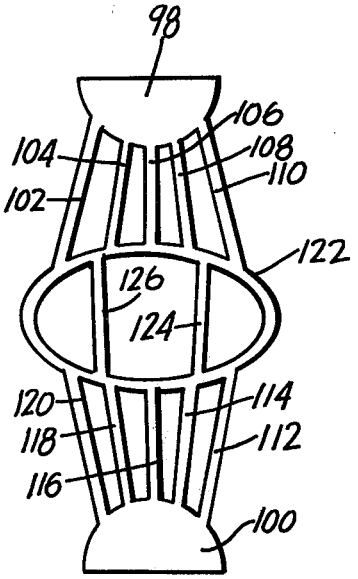
FIG. 7 illustrates a planar view of the movable portion of the first embodiment of the invention.
Figure 10:
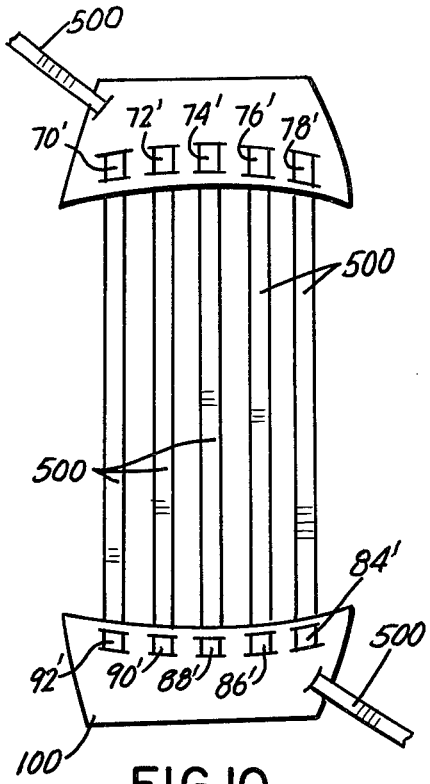
FIG. 10 illustrates a planar view of an alternate embodiment of FIG. 7.

FIG. 10 illustrates an alternate embodiment of FIG. 7, wherein straps 102, 104, 106, 108, 110 and 112, 114, 116, 118 120 are joined together into one continuous strap 500 which extends between the first and second geometrically shaped elements 98, 100 and are movable thereto such that elements 98 and 100 can overlap the front 12 and rear 14 pieces respectively of the glove 10 thereby forming a seal between the first geometrically shaped element 98 and front piece 12 and the second geometrically shaped element 100 and the rear piece 14. The slots or laced loops of FIG. 1—70, 72, 74, 76, 78, optionally can interlock with the corresponding vertical loops 70', 72', 74', 76', 78' of FIG. 10 so that when the front 98 moves upward its movable distance is limited to the vertical distance of the loops 70–78. Similarly, for the rear 100 when it moves downward, the corresponding interlocking vertical loops 84'–92' limit the movable distance down by rear geometric element 100 to the vertical distance of each loop 84'–92'. Of course there is a lesser amount of overlapping distance in the rear. Also front piece 12 and rear piece 14 hold the geometric elements of FIG. 10, 98 and 100 respectively, securely aligned. The arrows on FIG. 10 show the direction each element 98 and 100 move when they are in place on the glove to form the front and rear respectively.

In use, when the glove 10 is placed on the left hand of the player, the front piece 12 of the glove 10 is pulled into a concave configuration and the rear piece 14 of the glove 10 is in a convex configuration. The first geometrically shaped element 98 is pulled inwardly towards the central concave configuration thereby substantially forming the pocket in the palm area of the glove 10 in conjunction with the front piece 12 of the glove 10. As the first geometrically shaped element 98 is pulled upwardly into the concave configuration, it causes straps 102, 104, 106, 108, 110 to be pulled upwardly which force is transmitted through the two U-shaped straps 124, 126 thereby causing straps 112, 114, 116, 118, 120 and the second geometrically shaped element 100 to be pulled downwardly wherein the upper edge of the second geometrically shaped element 100 is pulled downwardly and over the outer lower surface of the rear piece 14 along the periphery of the cutout 68 of the rear piece 14. By permitting this movement of the second geometrically shaped element 100, increased flexibility is imparted to the rear portion of the glove 10 thereby increasing the ease of flexing of the glove 10 so as to form the proper pocket in the front portion of the glove 10.

When the glove 10 is placed on the right hand of the player, the rear piece 14 of the glove is pulled into a concave configuration and the front piece 12 of the glove 10 is in a convex configuration. The second geometrically shaped element 100 is pulled inwardly towards the central concave configuration thereby substantially forming the pocket in the palm area of the glove 10 in conjunction with the rear piece 14 of the glove 10. As the second geometrical shaped element 100 is pulled inwardly towards the central concave configuration, it causes straps 112, 114, 116, 118, 120 to be pulled upwardly which force is transmitted through the two U-shaped straps 124, 126 thereby causing straps 102, 104, 106, 108, 110 and the first geometrically shaped element 98 to be pulled downwardly, wherein the upper edge of the first geometrically shaped element 98 is pulled downwardly and over the outer lower surface of the front piece 12 along the periphery of the cutout 66 of the front piece 12. By permitting this movement of the first geometrically shaped element 98, increased flexibility is imparted to the back portion of the glove 10 thereby increasing the ease of flexing the glove 10 so as to form the proper pocket in the front portion of the glove 10.

Figure 4:
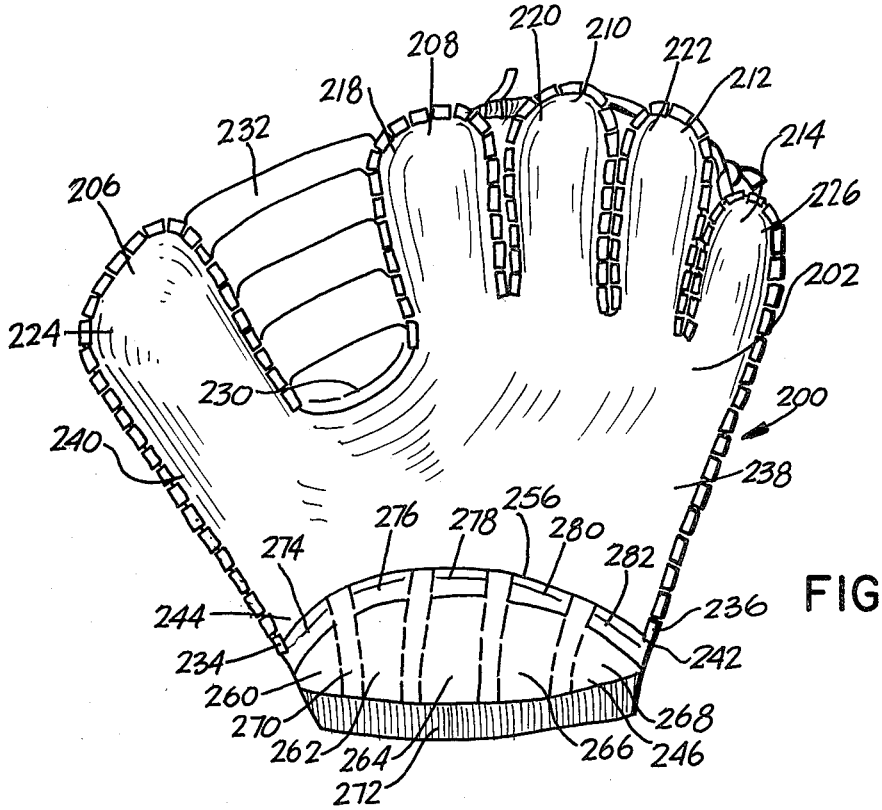
FIG. 4 illustrates a front perspective view of the second embodiment of the reversible baseball glove.
Figure 5:
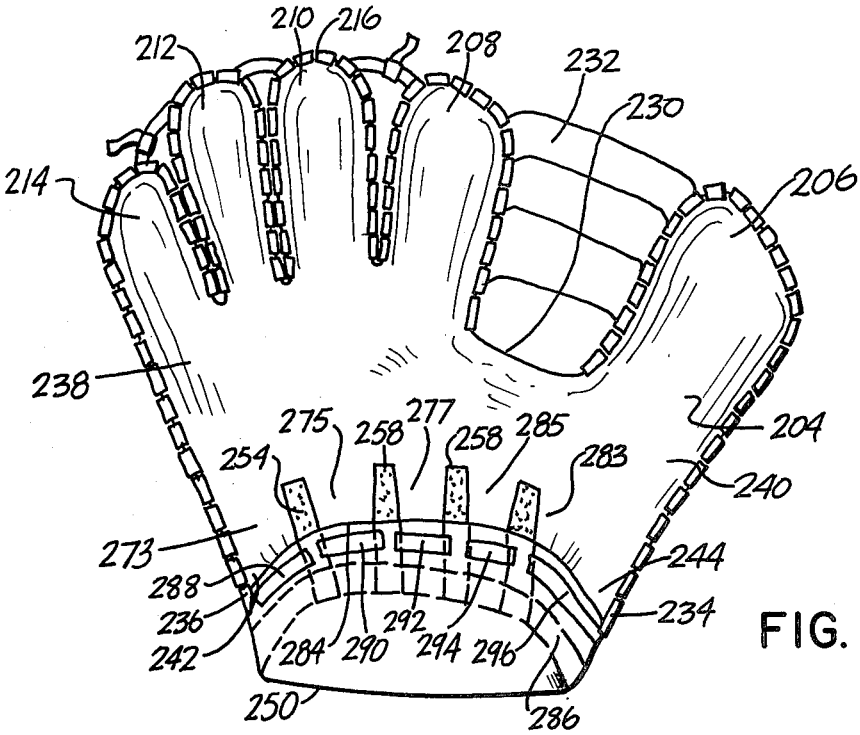
FIG. 5 illustrates a rear perspective view of the second embodiment of the reversible baseball glove.

An alternate embodiment of the reversible baseball glove 200 as shown in FIGS. 4–6 is adaptable to be worn either on the left or right hand of a player. The glove 200 generally comprises a front piece 202 and a back piece 204 of tough, flexible sheet material, such as leather or vinyl plastic, wherein each piece 202, 204 has five projections 206, 208, 210, 212, 214 along an upper edge of each piece 202, 204. The three center projections of each piece are joined together by lacing means 216 into a middle 220 and two intermediate finger stalls 218, 222 of the glove 200, wherein the finger stalls 218, 220, 222 are adapted to receive the three center fingers of a player's hand therein. The two outermost finger stalls 224, 226 formed by joining the projections 206, 214 of each piece 202, 204 together by the lacing means 216. Finger stall 224 is adapted to receive either the thumb of the left or the right hand of the player therein, wherein the little finger is accommodated in stall 226. A web 232 of similar material to that of pieces 202, 204 is positioned in the U-shaped opening 230 between the thumb 224 and forefinger 218 stalls and the web is joined by the lacing means 216 to the finger stalls 218, 224 and to the outer pieces 202, 204 in the pocket portion of the glove 200 along the bottom portion of the U-shaped opening 230. The lacing means 216 is continuous through the five finger stalls 224, 218, 220, 222, 226 and the web 232 wherein each of the ends 234, 236 of the lacing means 216 extend down along the respective sides 240, 238 of the glove 200 thereby joining the front 202 and back 204 pieces together.

The lacing means 216 is loose along the sides 238, 240 of the glove 200 thereby loosing joining pieces 202, 204 together. This provides for increased flexibility in pieces 202, 204 when they are respectively stretched as they form the rear portion of the glove 200 depending upon whether the glove 200 is worn on the player's left or right hand.

The ends 234, 236 of the lacing means 216 terminate at the lower end of each side 244, 242 of the heel section 246 of the glove 200. The lacing means 216 is laced through the two pieces 202, 204 and the web 232 in any desirable stitch, but as depicted in the Figures, but not limiting it in scope, is a saw tooth configuration. The bottom edges 248, 250 of each piece 202, 204 are not joined together thereby allowing the player's hand to be inserted upwardly and inwardly into the chamber formed between the two pieces 202, 204. A layer of padding 252 is disposed between the front 202 and back 204 pieces of the glove 200 and the padding 252 is of the same general configuration as that of either piece 202, 204. The lacing means 216 also extends through the padding 252 along the sides 238, 240 and the finger stalls 224, 218, 220, 222, 226 of the glove 200.

A liner 254 can be provided for the padding 252 which can be of unitary construction, FIG. 3, or two identical portions, FIG. 6, wherein each piece is of the same general configuration as those of pieces 202, 204 or padding 252. One portion of the liner 254 is disposed between padding 252 and front piece 202 and the other portion of the liner 254 is disposed between padding 252 and the back piece 204. The portions of the liner 254 are joined to the padding 252 by stitching means or alternately or in conjunction with by lacing means 216 extending also through the portions of the liner 254 along the finger stall sections 224, 218, 220, 222, 226 and the sides 238, 240 of the glove 200. The lower ends of each portion of the liner 254 are joined together either in a unitary construction as depicted or alternately by one end of lacing means 216 (not shown) extending across the bottom edge of the portions of the liner 254 and through the padding 252. Alternately to or independently of the peripheral lacing means, the bottom edge of the front piece 202 has a first geometrically shaped cutout 256 therein, wherein the curved portion of the cutout 256 extends upwardly, inwardly, and across the pocket portion of the glove 200. The bottom edge of the rear piece 204 has a second geometrically shaped cutout 258 therein, wherein the cutout 258 extends upwardly, inwardy and across the pocket portion of the glove 200.

From the lower edge of the front face 202 of the glove 200 along the periphery of the cutout 256 extend five strap members 260, 262, 264, 266, 268 which converge towards each other at the heel portion of the glove 200. A first geometrically shaped member 270 of the same geometrical shape as that of the cutout 256 is disposed within the geometrically shaped cutout 256 of the front face 202 of the glove 200. The first geometrically shaped member 270 is constructed of the same type material as that of the front face 202 of the glove 200. A first band member 272 is affixed along a lower edge of the first geometrically shaped member 270. The first geometrically shaped member 270 has five spaced slots 274, 276, 278, 280, 282 therethrough, wherein the slots 274, 276, 278, 280, 282 are disposed along an upper edge of the first geometrically shaped member 270. Each strap member 260, 262, 264, 266, 268 extends downwardly and exteriorally over the upper edge of the first geometrically shaped member 270, then passes through one of the slots 274, 276, 278, 280, 282 and then downwardly over the surface of the liner 254, and interiorally to the first geometrically shaped member 270, wherein the lower ends of the strap members 260, 262, 264, 266, 268 are affixed to the first band member 272. FIG. 6 shows these five strap members initially on the liner surface 254 because they are passing through five laced loops instead of five slot holes 274, 276, 278, 280, 282, there under the upper edge of the outer member 284, alternately.

From the lower edge of the rear face 204 of the glove 200 along the periphery of the cutout 258 extend five strap members 273, 274, 277, 285, 283 which gradually taper away from each other up to the heel portion of the glove 200. A second geometrically shaped member 284 of the same geometrical shape as that of the cutout 258 is disposed within the geometrically shaped cutout 258 of the rear face 204 of the glove 200. The second geometrically shaped member 284 is constructed of the same type material as that of the rear face 204 of the glove 200. A second band member 286 continuous with the first band member is affixed along an upper part of the second geometrically shaped member 284. The second geometrically shaped member 284 has five spaced slots 288, 290, 292, 294, 296 therethrough, wherein the slots 288, 290, 292, 294, 296 are disposed along an upper edge of the second geometrically shaped member 284. Each strap member 273, 275, 277, 285, 283 extends downwardly and exteriorally over the upper edge of the second geometrically shaped member 284, then passes through one of the slots 288, 290, 292, 294, 296, and then downwardly and interiorally to the second geometrically shaped member 284 wherein the lower ends of the strap members 273, 275, 277, 285, 283 are affixed to the second band member 286.

In use, when, for example, the glove 200 is placed on the player's left hand the pocket is formed in the front face 202 of the glove 200. The first geometrically shaped member 270 is moved upwardly on strap members 260, 262, 264, 266, 268, wherein the upper edge of the first geometrically shaped member 270 engages against the periphery of the cutout 256 of the front face 202 of the glove 200. The first band member 272 is rolled up thereby causing the strap members 260, 262, 264, 266, 268 to be rolled up within the first band member 272 which provides a means for maintaining the first geometrically shaped member 270 in its abutting position against the periphery of the cutout 256 of the front face 202 of the glove 200. The second geometrically shaped member 284 is moved downwardly along strap members 273, 275, 277, 285, 283 as the second band member 286 is unrolled thereby creating window like gaps that are suitable for the back of the hand as on conventional gloves between the upper edge of the second geometrically shaped member 284 and the periphery of the cutout 258 of the rear face 204 of the glove 200.

The periphery of the cutouts 256 and 258 and their matching geometrically shaped members 270 and 284 can be U-shaped as well as the reverse U-shapes shown here.

Figure 8:
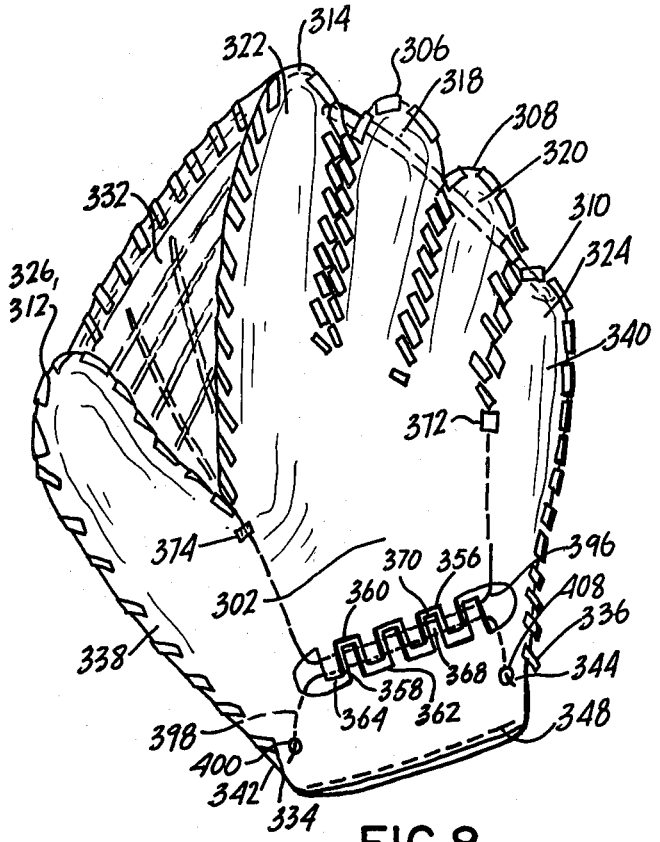
FIG. 8 illustrates a front perspective view of a third embodiment of the reversible baseball glove.
Figure 9:
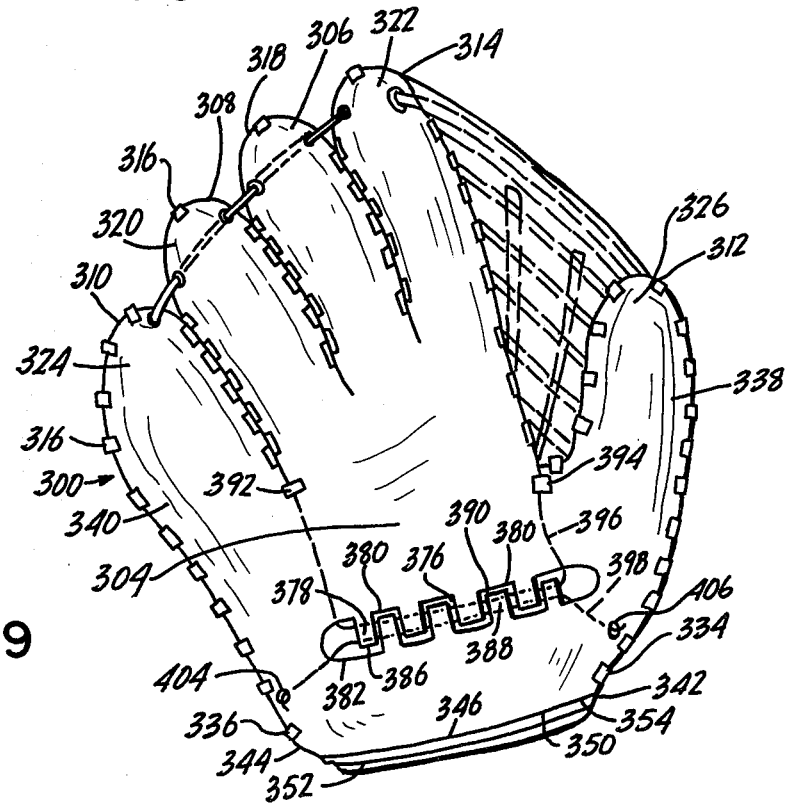
FIG. 9 illustrates a rear perspective view of the third embodiment of the invention.

A third embodiment—in essence a combination of the previous two embodiments, is the reversible baseball glove 300 as shown in FIGS. 8–9 and is adaptable to be worn either on the left or right hand of a player. The glove 300 generally comprises a front piece 302 and a back piece 304 of tough, flexible sheet material, such as leather or vinyl plastic, wherein each piece 302, 304 has five projections 312, 314, 306, 308, 310 along an upper edge of each piece 302, 304. Finger stall 326 is adapted to receive either the thumb of the left or the right hand of the player therein, wherein the other stalls receive the remaining corresponding fingers of either hand as the previous embodiments here.

A web 332 of similar material to that of pieces 302, 304 is positioned in the U-shaped opening between the thumb stall 326 and the forefinger stall 322 and the web is joined by the lacing means 316 to the finger stalls 322, 326 and to the pieces 302, 304 in the pocket portion of the glove 300 along the bottom portion of the U-shaped opening. The lacing means 316 is continuous through the five finger stalls 326, 322, 318, 320, 324 and the web 332, wherein each of the ends 334, 336 of the lacing means 316 extend down along the respective sides 338, 340 of the glove 300 thereby joining the front 302 and back 304 pieces together.

The lacing means 316 is loose along the sides 338, 340 of the glove 300 thereby loosing joining pieces 302, 304 and together. This provides for increased flexibility in pieces 302, 304 when they are respectively stretched as they form the rear portion of the glove 300 depending upon whether the glove 300 is worn on the player's right or left hand.

The ends 334, 336 of the lacing means 316 terminate at the lower end of each side 342, 344 of the heel portion 346 of the glove 300. The lacing means 316 is laced through the two pieces 302, 304 and the web 332 in any desirable stitch, but as depicted in the Figures, but not limiting it in scope, is a saw tooth configuration. The bottom edges 348, 350 of each piece 302, 304 are not joined together thereby allowing the player's hand to be inserted upwardly and inwardly into the chamber formed between the two pieces 302, 304. A layer of padding (not shown) is disposed between the front 302 and back 304 pieces of the glove 300 and the padding is of the same general configuration as that of either piece 302, 304. The lacing means 316 may also extend through portions of the padding 352 along the sides 338, 340 and the finger stalls 326, 322, 318, 320, 324 of the glove 300.

A cover or lining (not shown) can be provided for the padding which can be of unitary construction as 64 of FIG. 3 or two identical portions, as 254 of FIG. 6 wherein each piece is of the same general configuration as those of pieces 302, 304. One portion of the lining is disposed between padding as 62 of FIG. 3 and front piece 302, and the other portion of the lining is disposed between padding and the back piece 304. The portions of the lining are joined to the padding by stitching means or alternately or in conjunction with by means of the lacing means 316. The lower ends of each portion of the liner are joined together either in a unitary construction as depicted or alternately by one end of lacing means 316 (not shown) extending across the bottom edge of the portions of the liner and through the padding.

The palm portion of the front piece 302 of the glove 300 has an elongated cutout 356 therein, wherein cutout 356 extends transversely across the palm portion of the front piece 302. A plurality of first strap members 358 which are spaced apart extend downwardly from the upper edge 360 of the cutout 356 into the cutout area 356 and terminate slightly above the lower edge 362 of the cutout 356. The lower end 364 of each first strap member 358 is formed in the shape of a loop. A plurality of second strap members 368 which are spaced apart extend upwardly from the lower edge 362 of the cutout 356 into the cutout area 356 and terminate slightly below the upper edge 360 of the cutout 356, wherein the second strap members 368 are positioned between the first strap members 358 and the first strap members 358 are positioned between the second strap members 368. The upper end 370 of each second strap member 368 is formed in the shape of a loop. The front piece 302 of the glove 300 has two slot openings 372, 374 therein, wherein one opening 372 is disposed just below the juncture of finger stalls 320 and 324 and the other opening 374 is disposed just below the juncture of finger stalls 322, 326 or web 332.

The palm portion of the rear piece 304 of the glove 300 has an elongated cutout 376 therein, wherein cutout 376 extends transversely across the palm portion of the rear piece 304. A plurality of third strap members 378 which are spaced apart extend downwardly from the upper edge 380 of the cutout 376 into the cutout area 376 and terminate slightly above the lower edge 382 of the cutout 376. The lower end 386 of each third strap member 378 is formed in the shape of a loop. A plurality of fourth strap members 388 which are spaced apart extend upwardly from the lower edge 382 of the cutout 376 into the cutout area 376 and terminate slightly below the upper edge 380 of the cutout 376, wherein the fourth strap members 388 are positioned between the third strap members 378 and the third strap members 378 are positioned between the fourth strap members 388. The upper end 390 of each fourth strap member 388 is formed in the shape of a loop. The rear piece 304 of the glove 300 has two slot openings 392, 394 therein, wherein one opening 392 is disposed just below the juncture of finger stalls 320 and 324 and the other opening 394 is disposed just below the juncture of finger stalls 322, 326 or web 332. The front piece 302 also has two holes 400, 408 therethrough, wherein hole 400 is disposed at one heel corner and hole 408 is disposed at the other heel corner. The rear piece 304 also has two holes 404, 406 therethrough, wherein hole 404 is disposed at one heel corner and hole 406 is disposed at the other heel corner.

A first continuous band member 396 extends through the looped ends 370 of the second strap members 368 upwardly and interiorally through the glove 300, outwardly through opening 372, loops between finger stalls 308, 310, inwardly through opening 392, downwardly and interiorally through the glove 300, through the looped ends 390 of the fourth strap members, upwardly and interiorally through the glove 300, outwardly through opening 394, loops between finger stalls 322, 326, inwardly through opening 374, downwardly and interiorally through the glove to the looped ends 370 of the second strap member.

A second continuous band 398 extends through the looped ends 364 of the first strap members 358, downwardly and interiorally through the glove 300, outwardly through hole 400, loops over the heel corner 342 of the glove 300, inwardly through hole 406 upwardly and interiorally through the glove 300, through the looped ends 386 of the third strap members 378, downwardly and interiorally through the glove 300, outwardly through hole 404 loops over the heel corner 408, inwardly through hole 408, upwardly and interiorally through the glove 300 and through the looped ends 364 of the first strap members 358.

Both band members 396 and 398 can be a single band by a connection around opening 374 and hole 400 interiorally, and/or near the base of the little finger stall 324 and corner hole 408, interiorally.

What is claimed is:

1. A reversible baseball glove comprising (a) juxtaposed front and rear pieces of flexible sheet material, each said piece provided with a middle finger stall, two intermediate finger stalls and two outer finger stalls, a palm portion, and a heel portion, said front piece having a first cutout therein, said first cutout extending upwardly in a curved configuration into and across said palm portion of said front piece from said heel portion of said front piece, said rear piece having a second cutout therein, said second cutout extending upwardly in a curved configuration into and across said palm portion of said rear piece from said heel portion of said rear piece;

(b) a web disposed between one of said outer finger stalls and the adjoining intermediate finger stall;

(c) means for peripherally interconnecting said front piece and said rear piece, wherein said means joins said web to said front piece and said rear piece;

(d) a first geometrically shaped planar member of substantially identical shape to the shape of said first cutout of said front piece, said first geometrically shaped planar member being disposed within said first cutout of said front piece;

(e) first means for movably interconnecting said first geometrically shaped planar member to said front piece;

(f) a second geometrically shaped planar member of substantially identical shape to the shape of said second cutout of said rear piece, said second geometrically shaped planar member being disposed within said second cutout of said rear piece; and (g) second means for movably interconnecting said second geometrically shaped member to said rear piece.

2. A reversible baseball glove according to claim 1, further comprising a padding disposed between said front and said rear pieces, said padding being covered with a protective layer.

3. A reversible baseball glove according to claim 1, wherein said first interconnecting means further comprises:

(a) a plurality of first strap members extending downwardly from the edge of said first cutout of said front piece, said first strap members converging together at said heel portion of said glove, said first strap members extending downwardly and exteriorally to said first geometrically shaped planar member, then pass through slots in said first geometrically shaped planar member and then downwardly and interiorally to said first geometrically shaped planar member towards said heel portion of said glove; and (b) a first band member being joined to a lower portion of said first geometrically shaped planar member, the lower ends of said first strap members being connected to said first band member.

4. A reversible baseball glove according to claim 3, wherein said second interconnecting means further comprises:

(a) a plurality of second strap members extending downwardly from the edge of said second cutout of said rear piece, said second strap members then extending exteriorally to said second geometrically shaped planar member, passing through slots in said second geometrically shaped planar member and then downwardly and interiorally to said second geometrically shaped planar member towards said heel portion of said glove; and (b) a second band member optionally continuous with the first band member being joined to a lower portion of said second geometrically shaped planar member, the lower ends of said second strap members being connected to said second band member.

5. A reversible baseball glove according to claim 1, wherein said first and second interconnecting means further comprise (a) a plurality of first straps extending upwardly from an upper edge of said first geometrically shaped planar member into the space defined between said front piece and said padding;

(b) a plurality of second straps extending upwardly from an upper edge of said second geometrically shaped planar member into the space defined between said rear piece and said padding;

(c) an elongated continuous belt member disposed between said front piece and said padding and between said rear piece and said padding, the upper ends of said first and said second straps being joined to said belt member; and (d) at least two inverted U-shaped strap members, each said inverted U-shaped strap member having a base and a pair of legs, wherein the ends of said legs of each said inverted U-shaped strap member are joined to said elongated continuous belt member, wherein one of the legs of each said inverted U-shaped strap member extending upwardly in the space defined between said front piece and said padding and outwardly through one of a plurality of openings in said front piece, said base of said inverted U-shaped strap member being disposed between two of said finger stalls at the juncture of said finger stalls, said other leg of each said inverted U-shaped strap member extending through one of a plurality of openings in said rear piece, said other leg of said inverted U-shaped strap member extending downwardly in the space defined between said rear piece and said padding.

6. A reversible baseball glove according to claim 5, wherein there are two of said inverted U-shaped strap members.

7. A reversible baseball glove according to claim 1, wherein said first and said second means jointly comprise a continuous strap member extending between said first and said second geometrically shaped planar members.

8. A reversible baseball glove comprising (a) juxtaposed front and rear pieces of flexible sheet material, each said piece provided with a middle finger stall, two intermediate finger stalls and two outer finger stalls, a palm portion, and a heel portion, said palm portion of said front piece having a first cutout therein, said first cutout extending across said palm portion of said front piece, said rear piece having a second cutout therein, said second cutout extending across said palm portion of said rear piece, said front piece having a pair of openings therein and said rear piece having a pair of openings therein;

(b) a web disposed between one of said outer finger stalls and the adjoining intermediate finger stall;

(c) means for peripherally interconnecting said front piece and said rear piece, wherein said means joins said web to said front piece and said rear piece;

(d) a plurality of spaced apart first strap members extending downwardly from the upper edge of the first cutout in the front piece of the glove into the first cutout;

(e) a plurality of spaced apart second strap members extending upwardly from the lower edge of the first cutout in the front piece of the glove into the second cutout, said second strap members being positioned between said first strap members and said first strap members being positioned between said second strap members;

(f) a plurality of spaced apart third strap members extending downwardly from the upper edge of the second cutout in the rear piece of the glove into the second cutout;

(g) a plurality of spaced apart fourth strap members extending upwardly from the lower edge of the second cutout in the rear piece of the glove into the second cutout, said fourth strap members being positioned between said third strap members and said third strap members being positioned between said fourth strap members;

(h) a first continuous band member, said first band member extending through the upper ends of said second strap members and the upper ends of said fourth strap members; and (i) a second continuous band member, said second member extending through the lower ends of said first strap members and the lower ends of said third strap members.

* * * * *